US006237186B1

(12) United States Patent
Griffiths

(10) Patent No.: US 6,237,186 B1
(45) Date of Patent: May 29, 2001

(54) BUILT-IN WET/DRY VACUUM SYSTEM

(75) Inventor: Robert S. Griffiths, Salt Lake City, UT (US)

(73) Assignee: Bridgewater Corporation, Salt Lake City, UT (US)

( * ) Notice: Subject to any disclaimer, the term of this patent is extended or adjusted under 35 U.S.C. 154(b) by 0 days.

(21) Appl. No.: 09/414,174

(22) Filed: Oct. 7, 1999

(51) Int. Cl.[7] ..... A47L 5/38

(52) U.S. Cl. ..... 15/319; 15/302; 15/314; 15/353; 55/334; 55/DIG. 3

(58) Field of Search ..... 15/302, 314, 319, 15/352, 353; 55/334, DIG. 3

(56) References Cited

U.S. PATENT DOCUMENTS

| | | | | |
|---|---|---|---|---|
| 1,621,596 | * | 3/1927 | Minuth | 15/314 |
| 3,048,875 | * | 8/1962 | Bottinelli et al. | 15/314 |
| 3,173,164 | * | 3/1965 | Congdon | 15/314 |
| 3,705,437 | * | 12/1972 | Rukavina, Jr. et al. | 15/314 |
| 3,895,929 | * | 7/1975 | Jysky et al. | 55/334 |
| 4,284,422 | * | 8/1981 | Ferland | 55/334 |
| 4,580,309 | * | 4/1986 | Ogden | 15/314 |
| 4,641,392 | * | 2/1987 | Huisma | 15/314 |
| 4,821,367 | * | 4/1989 | McAllister et al. | 15/353 |
| 4,921,510 | * | 5/1990 | Plooy | 55/334 |
| 5,032,155 | * | 7/1991 | Wiese et al. | 15/353 |
| 5,080,697 | * | 1/1992 | Finke | 55/DIG. 3 |
| 5,182,834 | * | 2/1993 | Wright et al. | 15/353 |
| 5,465,455 | * | 11/1995 | Allen | 15/353 |
| 6,009,596 | * | 1/2000 | Buss et al. | 15/353 |

* cited by examiner

*Primary Examiner*—Terrence R. Till
(74) *Attorney, Agent, or Firm*—Workman, Nydegger & Seeley

(57) ABSTRACT

A built-in wet/dry vacuum system includes a canister having an inlet port, an air outlet port, and a liquid outlet port. The canister bounds a chamber configured to hold a liquid. A transfer conduit couples with the canister though the inlet port. The first end of the transfer conduit is configured to couple with a vacuum hose and select adapters. A vacuum motor is coupled with the canister so as to produce a relative vacuum within the chamber when the vacuum motor is turned on. A float switch is disposed within the chamber and is electrically coupled with a vacuum motor. The float switch is configured to selectively turn the vacuum motor on and off based on the level of the liquid within the chamber. A check valve is coupled with the liquid outlet port. The check valve precludes the passage of liquid therethrough when the vacuum motor is turned on and enables the discharge of liquid therethrough when the vacuum motor is turned off. A fluid line is coupled with the transfer conduit adjacent to the canister. The fluid line dispenses fluid into the transfer conduit when the vacuum motor is turned on such that particulate traveling through the transfer conduit becomes suspended within the liquid prior to entering into the chamber.

25 Claims, 5 Drawing Sheets

BUILT-IN WET/DRY VACUUM SYSTEM

BACKGROUND OF THE INVENTION

1. The Field of the Invention

The present invention relates to vacuums and, more specifically, built-in wet/dry vacuum systems.

2. Present State of the Art

Conventional stand alone vacuums have long been used for cleaning carpets. Such vacuums also typically include various adapters which enable the vacuum to be used in cleaning hard floor surfaces and non-floor surfaces that are difficult to reach. Although conventional vacuums are still widely used, they have various shortcomings. For example, vacuums are often heavy and difficult to carry between floors for cleaning. Furthermore, conventional vacuums can be awkward to use when cleaning areas, such as stairs, where the vacuum must be balanced while an adapter is used.

In one approach to overcoming some of the shortcomings of conventional vacuums, built-in vacuum systems have been used. Such systems can be incorporated into homes, offices, and other building structures. A conventional built-in vacuum system includes a canister which is typically mounted in an out-of-the-way location, such as in a garage. Coupled with the canister is a conduit. The conduit branches throughout the building with each branch terminating at a port. The canister has a chamber which is configured to hold and collect dry vacuumed particles. Coupled with the canister is a vacuum motor which produces a relative vacuum or negative pressure within the chamber. The relative vacuum draws air into the canister through the conduit. The air is then filtered and expelled out through a vent line.

During use, an individual couples a hose to a corresponding port which automatically turns on the vacuum motor. A tool, such as a nozzle, is selectively attached to the hose. The tool can have a variety of different configurations depending on the type surface to be cleaned. Since the tool does not include the vacuum motor nor does it retain the collected waste material, the tool is typically much lighter and smaller than a conventional vacuum, thereby minimizing the required effort in the cleaning process. Once a specific area is cleaned, the hose and tool are disconnected and moved to the next vacuum port. An individual can thus easily and quickly move throughout a building cleaning different surfaces and areas.

Although built-in vacuum systems solve some problems, they still maintain several shortcomings. For example, neither conventional vacuums nor built-in vacuum systems are capable of either cleaning up spilled liquid or applying a cleaning solution to a desired surface and then collecting the cleaning solution. One conventional method for cleaning carpets and furniture is to spray a hot liquid cleaning solution onto the item and then suck the cleaning liquid and suspended dirt into a container. As neither conventional stand alone vacuums nor built-in vacuum systems are designed to dispense or collect liquids, such cleaning is typically accomplished by either hiring a professional carpet cleaner or renting specialized carpet cleaning equipment. Conventional stand alone wet/dry vacuums can also be purchased. Wet/dry vacuums, however, are typically designed to suck liquid and dry matter into a canister. Such vacuums are not designed for use in dispensing liquid nor are they designed for use with adapters having rotatable brushes for cleaning carpets. An additional problem with convention wet/dry vacuums is that they require the user to manually carry and dispose of the collected liquid.

OBJECTS AND BRIEF SUMMARY OF THE INVENTION

Accordingly, it is an object of the present invention to provide improved vacuum systems that can be used for collecting dry material, collecting spilt liquid, and/or dispersing a cleaning liquid and then collecting the cleaning liquid.

Another object of the present invention is to provide wet/dry vacuum systems as above which can be built into a structure such as a house or office building.

Finally, another object of the present invention is to provide the above built-in wet/dry vacuum systems which automatically dispose of the collected liquid To achieve the foregoing objects, and in accordance with the invention as embodied and broadly described herein, a built-in wet/dry vacuum system is provided. The vacuum system includes a canister having an inlet port, an air outlet port, and liquid outlet port. A transfer conduit has a first end disposed outside of the canister and an opposing second end coupled with the canister through the inlet port. Mounted at the first end of the transfer conduit is a vacuum port to which a vacuum hose and various adapters can be selective coupled. Positioned adjacent to the vacuum port is a fluid port. The fluid port is coupled with a fluid line through which water and select cleaning agents are delivered. Various liquid dispensing hoses and tools can be selectively coupled with the fluid port.

Disposed within the canister is a vacuum motor. Mounted on one side of the vacuum motor is a vent line which exits the canister through the air outlet port. Mounted on the opposing side of the vacuum motor is a frustaconical separator. Disposed below the frustaconical separator is a collection cone. Removable mounted at the base of the collection cone is a filter bag. When the vacuum motor is turned on, a relative vacuum or negative pressure is produced within the canister. This relative vacuum is used to draw air, dry matter, and liquid into the canister through the transfer conduit. The matter entering the canister centrifugally spins at high speeds such that the liquid and particles are separated towards the interior surface of the canister. The relatively clean air is then drawn up through the center of the separator and out through the vent line. The separated liquid and particles are drawn down under gravitational force through the collecting cone and into the filter bag. The larger particles are retained within the filter bag while the fluid and smaller particles collect in the bottom of the canister.

A check valve is coupled with the liquid outlet port such that when the vacuum motor is in operation, the check valve is closed causing the waste liquid and particles to be retained within the canister. When the vacuum motor is turned off, the check valve is opened and the waste liquid and particles travel out through a drain line to a sewage system. To prevent over filling of the canister with liquid, a float switch is disposed within the bottom of the canister. When the liquid rises to a predetermined upper level within the canister, the float switch moves to a first activation state, thereby turning off the vacuum. Once the liquid drains to below a predetermined lower level, the float switch moves to a second activation state, thereby causing the vacuum motor to turn on again.

To facilitate removal of particulate from the air entering the canister, a fluid line is also coupled with the transfer conduit adjacent to the canister. The transfer conduit includes a mixing tube which horizontally projects a distance into the canister. When the vacuum motor is in operation, water is dispensed from the fluid line into the transfer conduit which then flows through the mixing tube. As the water travels through the mixing tube, the water mixes with the surrounding air so that the particles therein become suspended within the water. The water then subsequently travels to the bottom end of the canister, as previously discussed, where it is dispensed.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention relates to wet/dry vacuum systems that can be permanently built into a home, office building, or other desired building structure. These built-in wet/dry vacuum systems can be used with conventional adapters to function like built-in dry vacuum system for cleaning floors and other areas. Unlike conventional dry vacuum systems however, the inventive built-in wet/dry vacuum systems can also be used to clean up spilled liquids and can be used with a variety of other adapters for both dispensing and collecting liquid cleaning solutions.

Figure 1:
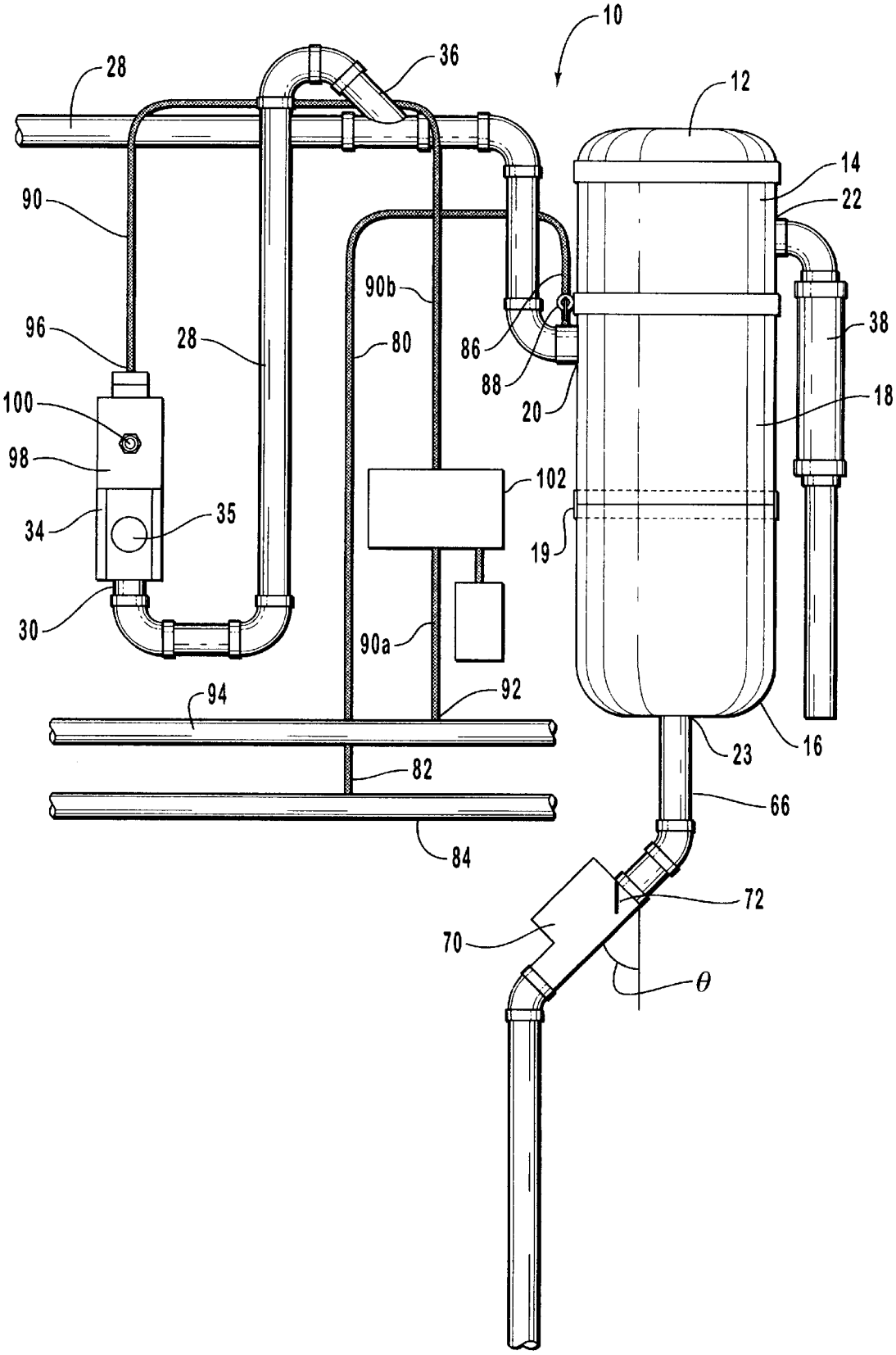
FIG. 1 is a front view of an inventive built-in wet/dry vacuum system.

Depicted in FIG. 1 is one embodiment of an inventive built-in wet/dry vacuum system 10 incorporating features of the present invention. Vacuum system 10 includes a canister 12 having a top section 14, a bottom section 16, and a middle section 18 disposed therebetween. Sections 14, 16, and 18 are removable coupled together using conventional clamping members 19. In one embodiment, sections 14, 16, and 18 are coupled together so as to produce a liquid tight seal therebetween.

Figure 2:
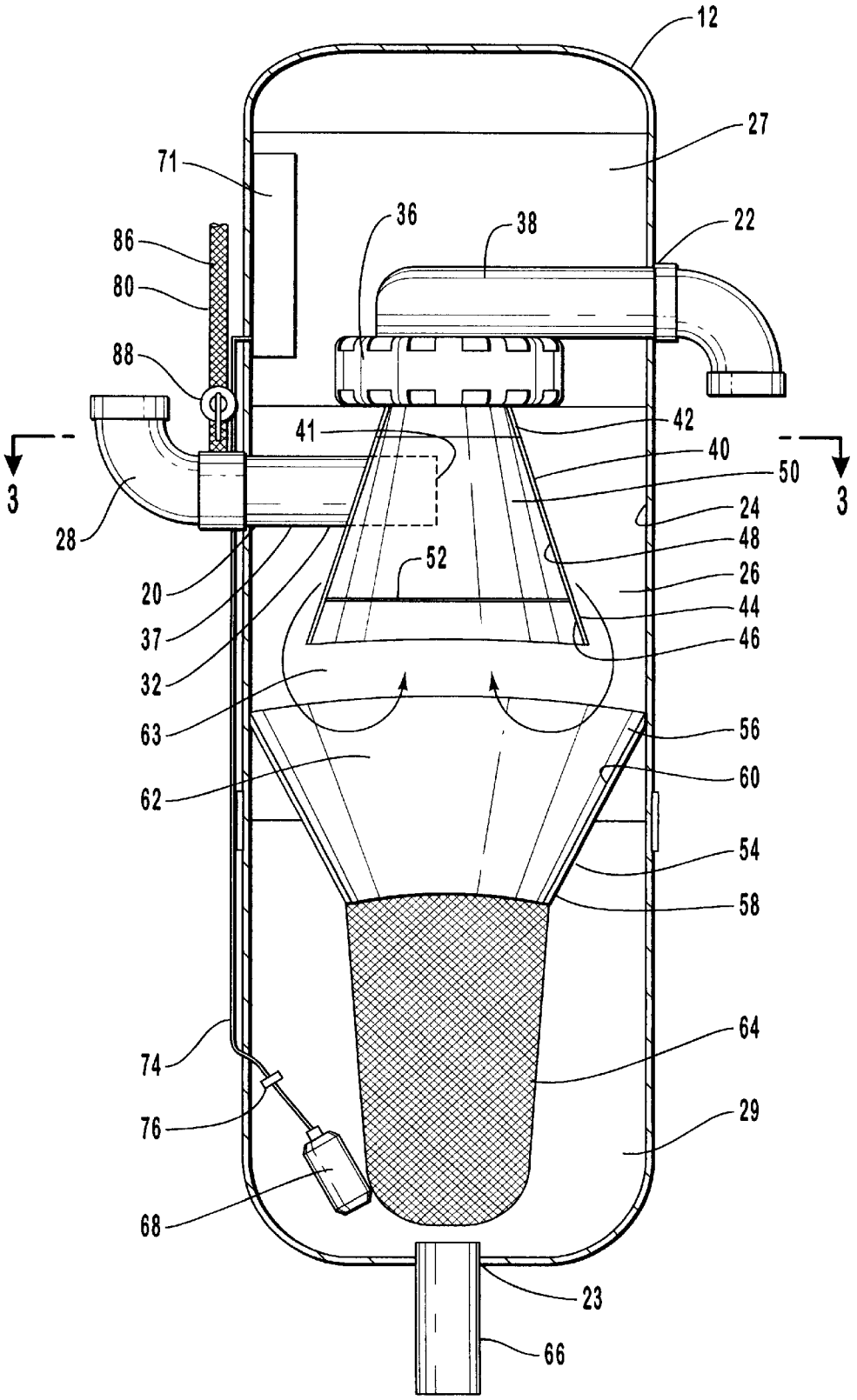
FIG. 2 is a cross sectional front view of a canister of the built-in wet/dry vacuum system shown in FIG. 1.

Depicted in FIG. 2, canister 12 has an interior surface 24 bounding a chamber 26. Chamber 26 includes a top end 27 and an opposing bottom end 29. Chamber 26 communicates with the exterior through an inlet port 20, an air outlet port 22, and a liquid outlet port 23.

Coupled with chamber 26 through inlet port 20 is a transfer conduit 28. As depicted in FIGS. 1 and 2, transfer conduit 28 extends from an attachment end 30 disposed outside of canister 12 to an opposing discharge end 32 coupled with chamber 26 through inlet port 20. Secured to attachment end 30 is a vacuum port 34. Vacuum port 34 has a socket 35 that is configured to selectively couple with a flexible hose to which various tools or adapters can be secured. The hose and tools are not depicted herein. Such tools, however, can include, by way of example and not by limitation, dry vacuum nozzles, vacuum heads having a rotor brush, floor and wall brushes, upholstery brushes, and carpet groomers.

Vacuum port 34 is configured such that when a hose is attached thereto, open fluid communication is established between the hose, transfer conduit 28, and canister 12. When the hose is removed, vacuum port 34 seals off fluid communication between transfer conduit 28 and the exterior. In one embodiment, vacuum port 34 comprises a conventional vacuum port used with standard built-in dry vacuum systems In the embodiment depicted, a plurality of transfer conduits 28 are interconnected by branching joints 36. Each transfer conduit 28 terminates at a discrete attachment end 30 having a vacuum port 34 coupled therewith. Vacuum ports 34 are located at predetermined locations throughout the building for selective cleaning thereat. In an alternative embodiment, a plurality of discrete conduits 28 can be directly couple with canister 12.

Figure 3:
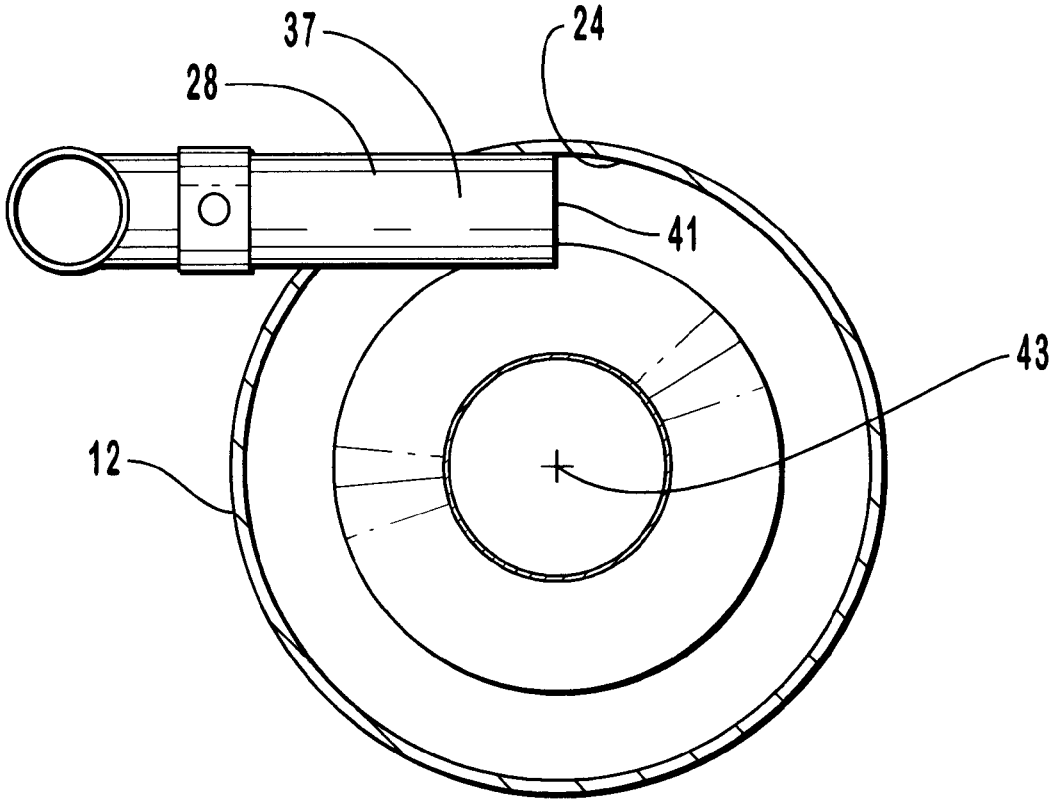
FIG. 3 is a cross-sectional top view of canister shown in FIG. 2 taken along section lines 3—3.

Depicted in FIG. 2, transfer conduit 28 includes a mixing tube 37 positioned at discharge end 32. Mixing tube 37 is horizontally disposed within chamber 26 and extends from interior surface 24 of chamber 26 to a terminus 41. As depicted in FIG. 3, mixing tube 37 is oriented at an angle that is offset from alignment with central longitudinal axis 43 of chamber 26. In the embodiment depicted, terminus 41 is disposed adjacent to interior surface 24. In this configuration, mixing tube 37 is oriented so that air exits mixing tube 37 through terminus 41 at an orientation substantially tangential to interior surface 24. As discussed below in greater detail, this orientation of mixing tube 37 optimizes the cyclonic flow of air within chamber 26.

In one embodiment of the present invention, vacuum means are provided for producing a relative vacuum or relative negative pressure within chamber 26 such that dry matter and liquid can be drawn into chamber 26 through transfer conduit 28. By way of example and not by limitation, depicted in FIG. 2, a conventional vacuum motor 36 is disposed within top end 27 of chamber 26. A vent line 38 couples with one side of vacuum motor 36 and exits through air outlet port 22. In alternative embodiments for the vacuum means, vacuum motor 36 can have a variety of different configurations and can be placed at a variety of different locations both within and outside of the chamber 26. As discussed later in greater detail, in embodiments where vacuum motor 36 is disposed outside of chamber 26, vacuum motor 36 communicates with and draws air out of chamber 26 through a conduit.

A cyclonic separator 40 is attached to the opposing side of vacuum motor 36. In the embodiment depicted, separator 40 has a frustaconical configuration and includes a constricted upper end 42 coupled with vacuum motor 36 and a radially outwardly flared lower end 44. In alternative embodiments, the exterior of separator 40 need not be frustaconical, but preferably has a lower end having a diameter greater than the diameter of the upper end. Lower end 44 is freely disposed within chamber 26 and bounds an opening 46. Separator 40 has an interior surface 48 that bounds a passageway 50 extending from opening 46 to vacuum motor 36. Separator 40 is disposed such that mixing tube 37 of transfer conduit 28 is disposed above lower end 44 of separator 40. Transversely extending across passageway 50 is a filter 52. In one embodiment, filter 52 comprises a plastic mesh screen having a pore diameter in a range between about 0.1 inches to about 0.5 inches with about 0.1 to about 0.3 inches being more preferred.

Also disposed within chamber 26 is a frustaconical collecting cone 54. Collecting cone 54 includes a radially enlarged upper end 56 that is secured to interior surface 24 of canister 12. Collecting cone 54 also includes a constricted lower end 58. An interior surface 60 bounds a passageway 62 extending between ends 56 and 58. Collecting cone 54 is concentrically disposed below separator 40 with a gap 63 formed therebetween. Secured to lower end 58 of collecting cone 54 is an enlarged filter bag 64. Filter bag 64 is removably secured to collecting cone 54 using conventional connecting means such as hooks, snaps, or ties. Filter bag 64 is configured to allow liquids to pass therethrough but to retain larger particles therein. In one embodiment, filter bag 64 is made from mesh netting. In an alternative embodiment, collecting cone 54 can be removed and filter bag 64 can be configured to removably attach directly to interior surface 24 of canister 12.

Communicating with chamber 26 through liquid outlet port 23 is a drain line 66. Drain line 66 functions to discharge waste liquid collected within bottom end 29 of chamber 26. In one embodiment, drain line 66 feeds to a sewage line, septic tank, or disposal container.

When vacuum motor 36 is turned on, a relative vacuum is produced within chamber 26. This relative vacuum produces a suction which is used to draw air, dry matter, and/or liquid into chamber 24 through transfer conduit 28. Because of the orientation of mixing tube 37, the air and other matter enters chamber 26 at an orientation substantially tangential with interior surface 24 of canister 12. As a result, a substantially cyclonic flow is created within chamber 24 wherein the air and other matter swirls in a circular and downward path within chamber 24. As the circling air moves downward, the space between the exterior surface of separator 40 and interior surface 24 of canister 12 decreases. As this space decreases, the speed of the air traveling within this space increases. The centrifugal force created by the increased air speed causes the liquid and particulate suspended within the air to move outward towards interior surface 24 of canister 12. As the air and other matter passes below lower end 44 of separator 40, the relatively clean air passes through gap 63 where it is drawn up into passageway 50, through motor 26, and out vent line 38. Filter 52 functions to catch any additional material that is accidentally drawn in with the air.

The liquid and particulate continue under gravitational force to travel down into passageway 60 of collecting cone 54 and into filter bag 64. The larger objects are retained within filter bag 64. The liquid and smaller particles suspended therein are collected at bottom end 29 of chamber 26.

In one embodiment of the present invention, valve means are provided for automatically stopping the flow of the waste liquid from chamber 26 through fluid outlet port 23 when the vacuum means is on and for permitting the flow of the waste liquid from chamber 26 through fluid outlet port 23 when the vacuum means is off. By way of example and not by limitation, depicted in Figure a check valve 70 having a flapper 72 is mounted in fluid communication along drain line 66.

During operation of vacuum motor 36, the relative vacuum produced within chamber 36 causes flapper 72 to rotate upward, thereby sealing drain line 66 closed. Sealing drain line 66 closed is useful in producing a strong relative vacuum within chamber 26. With drain line 66 closed, fluid and other waste collects within bottom end 29 of chamber 26. When vacuum motor 36 is turned off, the waste liquid pushes against flapper 72 which rotates flapper 72 into an open position, thereby allowing the waste liquid to exit chamber 26 out through drain line 66. To facilitate ease in opening and closing check valve 70, in one embodiment, check valve 70 is oriented at an angle θ relative to vertical in a range between 30° to about 60° with about 40° to about 50° being more preferred.

The present invention also envisions a variety of alternative embodiments for the valve means. By way of example, check valve 70 can be replaced with an electronically operated valve, such as a solenoid actuated gate valve. The electronically operated valve is coupled with vacuum motor 36 so as to close when vacuum motor 36 is on and to open when vacuum motor 36 is off. In yet another embodiment, there are a variety of different types of floating ball valves that can be used. When a vacuum is applied to the floating ball valve, the ball lodges to prevent passage of a fluid therethrough. When the vacuum is removed, the passage is opened.

In one embodiment, vacuum system 10 is designed such that when the vacuum hose is coupled with a select vacuum port 34, vacuum motor 36 is automatically turned on. Likewise, vacuum motor 36 is automatically turned off when the hose is removed from vacuum port 34. In alternative embodiments, vacuum motor 36 can be turned on and off by a switch located on or adjacent to vacuum port 34.

To prevent over filling chamber 26 with liquid, the present invention also includes switch means for automatically turning off the vacuum means when the waste liquid within chamber 26 rises to a predetermined upper level and for automatically turning off the vacuum means when the waste liquid within chamber 26 drops to a predetermined lower level. By way of example and not by limitation, depicted in FIG. 2, a float switch 68 is disposed within the bottom of chamber 26. One example of float switch 68 is the Solo-Float model D10N0 115 available from Anchor Scientific Inc. out of Long Lake, Minn.

Float switch 68 is in electrical communication with a control panel 71 by an electrical line 74. Vacuum motor 36 is also electrically coupled with control panel 71. A tie 76, such as a clamp, secures electrical line 74 to canister 12 at a short distance from float switch 68. Tie 76 functions to tether float switch 68 so that float switch 68 rotates upward as waste liquid fills in chamber 26 and rotates downward as waste liquid exits chamber 26.

Accordingly, as liquid collects and rises within the bottom of chamber 24, float switch 68 rotates upward around tie 76. When float switch 68 is rotated upward to a predetermined angel based on the elevation of the waste liquid, float switch 68 automatically moves to a first activation states which turns vacuum motor 36 off. With vacuum motor 36 off, check valve 70 is opened allowing the waste liquid to drain out through drain line 66. As liquid drains from chamber 24, float switch 68 rotates downward around tie 76. When float switch 68 is rotated downward to a predetermined angel based on the elevation of the water, float switch 68 automatically moves to a second activation states which turns vacuum motor 36 on, thereby closing check valve 70. This process continues until vacuum motor is manually turned off. By selectively adjusting the distance between tie 76 and float switch 68, the level of the waste liquid at which float switch 68 moves between the activation states can be controlled.

The present invention also envisions a variety of alternative embodiments for the switch means. By way of example, float switch 68 can be replaced with sensors vertically spaced apart within chamber 26. When the waste liquid rises to the upper sensor, vacuum motor 36 is turned off. When the waste liquid drops below the lower sensor, vacuum motor 36 is turned on.

As depicted in FIG. 1, to facilitate removal of particulate suspended within the air drawn into chamber 26, a fluid line 80 has a first end 82 fluid coupled with a cold water line 84 and an opposing second end 86 fluid coupled with transfer conduit 28. Second end 86 of fluid line 80 is coupled at or adjacent to mixing tube 37. A valve 88, such as an electronically operated solenoid valve, is coupled with fluid line 80 to control the flow of water into transfer conduit 28. In one embodiment, valve 88 is electrically coupled with control panel 71 such that when vacuum motor 36 is turned on, valve 88 is opened allowing water to be dispensed into transfer conduit 28.

As the water enters transfer conduit 28 and travels along mixing tube 37, the water mixes with the surrounding air so that the particles become suspended within the water. Once the water enters chamber 26, as previously discussed, the water and suspended particles are driven outward against interior surface 24 of canister 12 and downward toward bottom end 29 of chamber 26. This collected waste liquid is then subsequently dispensed out through drain line 66. It is also noted that the water from fluid line 80 not only helps to collect and remove particulate from the air, is also functions to help wash the particulate matter down the length of chamber 26 to bottom end 29.

Valve 88 can also be electrically coupled with float switch 68. Accordingly, when float switch 68 is moved to its first activation state so as to turn vacuum motor 36 off, valve 88 is also automatically closed. This configuration helps to eliminate unnecessary waste of water. When float switch 68 is moved to the second activation state, valve 88 is automatically opened concurrently with the turning on of vacuum motor 36.

Although the following flow rates and dimensions can vary based on the size and number of vacuum motors used, in one embodiment, mixing tube 37 has a diameter in a range between about 1.5 inches to about 2.5 inches, the length of mixing tube 37, i.e., the distance between where fluid line 80 intersects transfer conduit 28 and terminus 41, is in a range between about 11 inches to about 5 inches, and the flow rate of water entering mixing tube 37 through fluid line 80 is in a range between about 0.15 gallons/minute to about 0.35 gallons/minute. The present invention also envisions that mixing tube 37 can be fully positioned within chamber 26, fully positioned outside canister 12, or extend both inside and outside of chamber 26.

Depicted in FIG. 1, vacuum system 10 also includes a fluid dispensing line 90 having a first end 92 fluid coupled to a hot water line 94 and an opposing second end 96 fluid coupled to a fluid port 98. In one embodiment, a fluid port 98 is disposed adjacent to each vacuum port 34. Fluid port 98 includes a quick connect fluid fitting 100. Fluid fitting 100 enables quick fluid connection to a dispensing hose on which a variety of different adapter and tools can be attached. By way of example, such tools can include upholstery and spotting tools, carpet cleaning tools, pre-sprayers, and other types of sprayers used in cleaning. The tools used in association with fluid port 98 may be separate from or combined with the tools used with vacuum port 34.

Figure 4:
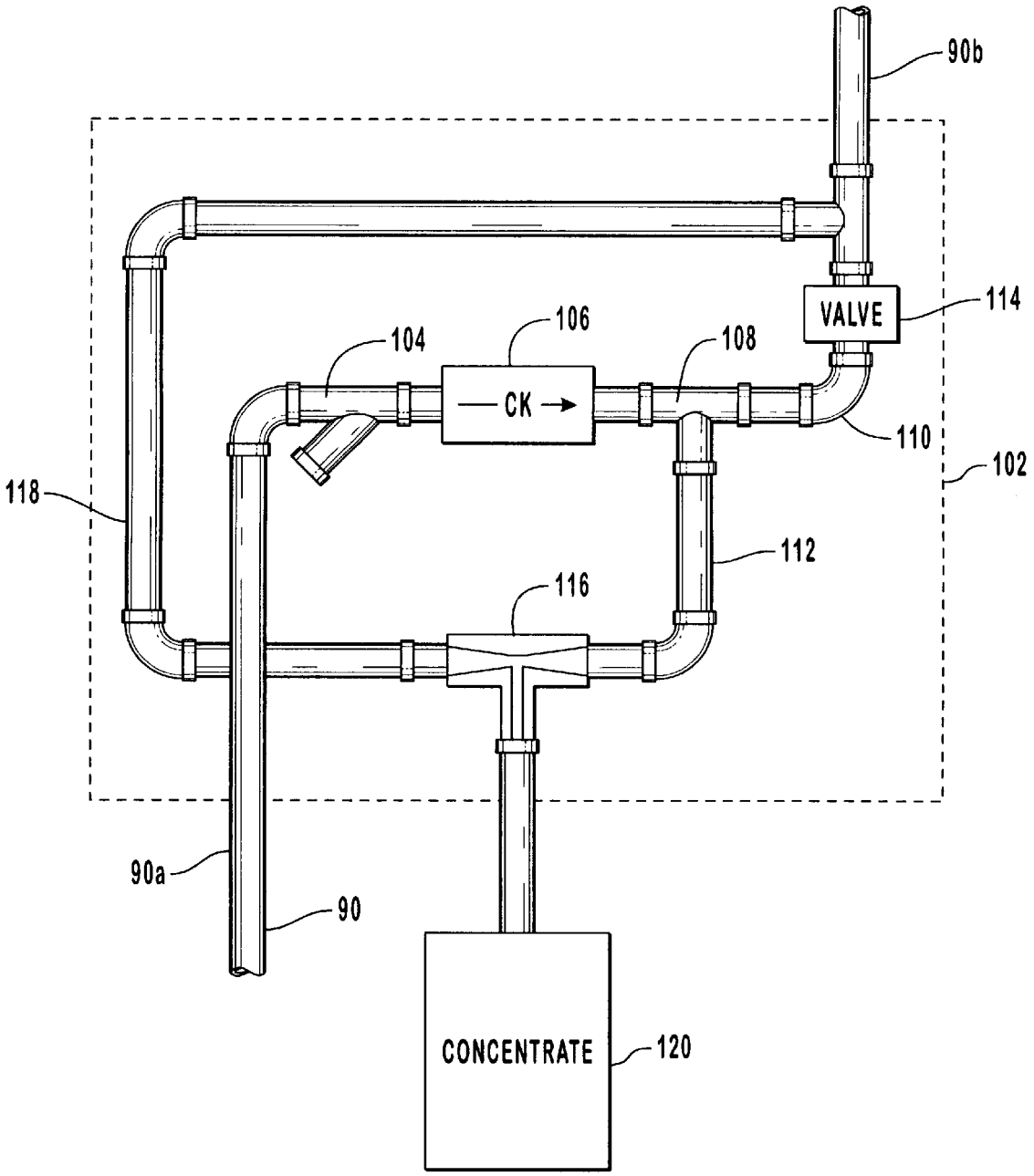
FIG. 4 is a front view of a mixing system used with the built-in wet/dry vacuum system shown in FIG. 1.

The present invention also includes means for injecting a concentrate into fluid dispensing line 90. By way of example and not by limitation, as depicted in FIG. 1, a selective mixing system 102 is fluid coupled with fluid dispensing line 90. As depicted in FIG. 4, a lower portion 90*a* of dispensing line 90 feeds into a filter 104 and a check valve 106. Check valve 106 feeds into a T-fitting 108. T-fitting 108 is coupled with a first conduit portion 110 and a second conduit portion 112. First conduit portion 110 fluid couples with an upper portion 90*b* of fluid dispensing line 90 by way of a manually operated valve 114. Second conduit portion 112 fluid couples with a venturi fitting 116. Venturi fitting 116 is fluid coupled with a third conduit portion 118 that connects with upper portion 90*b* and is fluid coupled with a container 120 configured to hold a concentrate.

During operation, when valve 114 is opened, water travels directly from lower portion 90*a*, through filter 104, check valve 106, first conduit portion 110, and out through valve 114 into upper portion 90*b*. The constriction of venturi fitting 116 prevents the water from passing therethrough. When valve 114 is closed, the fluid from lower portion 90*a* travels through filter 104, check valve 106, second conduit portion 112, venturi fitting 116, and then back to upper portion 90*b* through third conduit portion 118. As the water passes through venturi fitting 116, the water is initially compressed and then expanded. This compression and expansion produces a venturi which draws the concentrate from within container 120 and mixes it with the water flowing therethrough. As a result, when the valve 114 is closed, the fluid dispensed out through fluid port 98 is a mixture of water and concentrate. The concentrate can comprise any desired liquid composition such as liquid soap, carpet cleaning solution, or spot cleaning solution.

Figure 5:
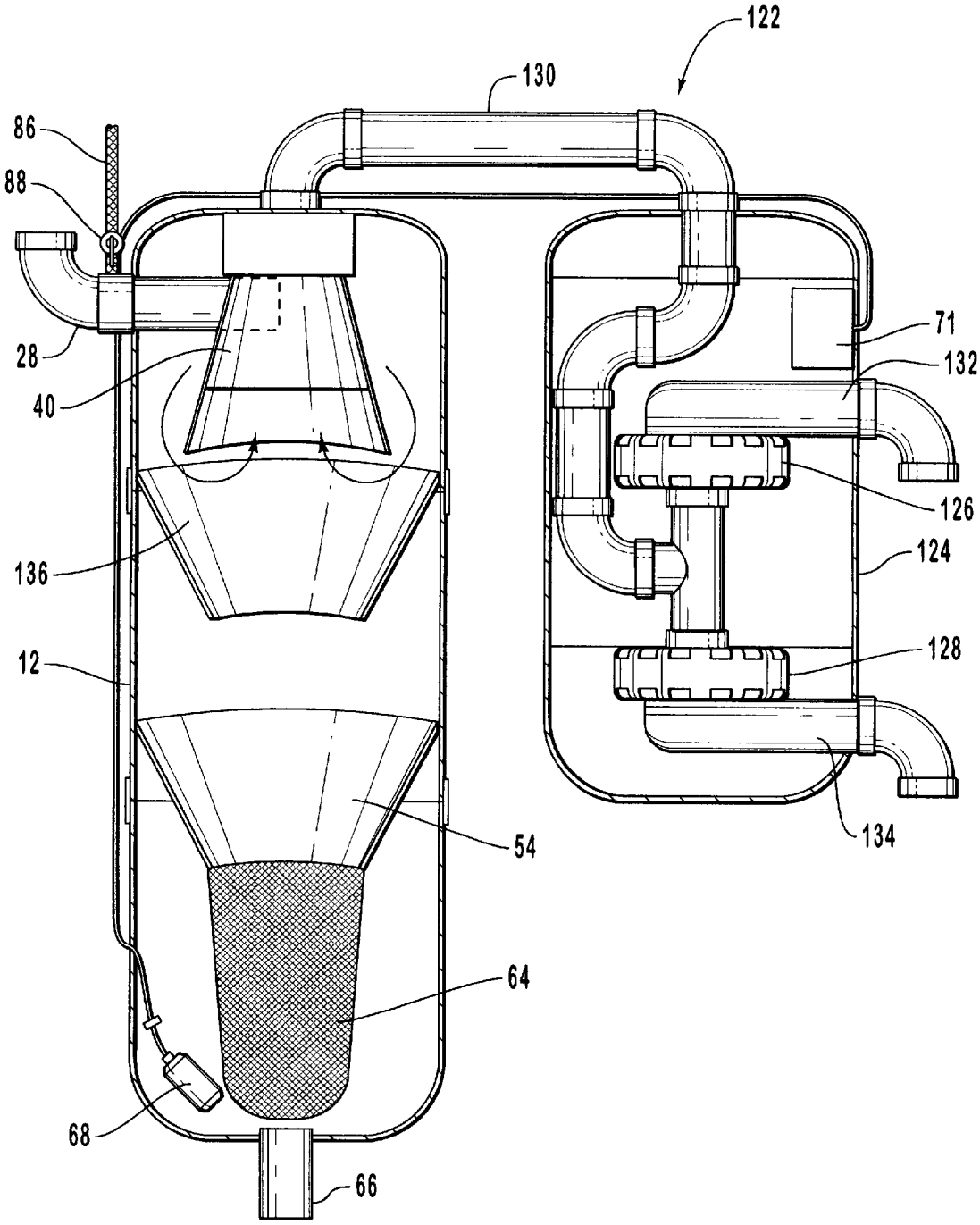
FIG. 5 is an alternative embodiment of the built-in wet/dry vacuum system shown in FIG. 1 having two canisters.

Depicted in FIG. 5 is an alternative embodiment of the inventive built-in wet/dry vacuum system. Like elements between the embodiments depicted in FIGS. 2 and 5 are identified by like reference characters. As depicted in FIG. 5, a wet/dry vacuum system 122 includes canister 12 having collecting cone 54, filtering bag 64, and float switch 68 disposed therein. Also disposed within canister 12 is separator 40. In contrast to the embodiment depicted FIG. 2, however, vacuum motor 36 is removed from canister 12. An adjacent second canister 124 is provided having a first vacuum motor 126 and a second vacuum motor 128. Each of the vacuum motors 126 and 128 are fluid coupled with separator 40 through a conduit 130. Each of motors 126 and 128 vent to the exterior through corresponding vent lines 132 and 134.

Vacuum system 122 is also distinguished over vacuum system 10 in that control panel 71 is moved from canister 12 to second canister 124. Furthermore, a preliminary collecting cone 136 is disposed between collecting cone 54 and separator 40. The use of second canister 124 and vacuum motors 126 and/or 128 are alternative embodiment to the vacuum means as previously discussed.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A vacuum system for vacuuming both dry matter and liquid, the system comprising:

(a) a first canister having an inlet port, an air outlet port, and a liquid outlet port, the first canister having a chamber configured to hold the liquid;

(b) vacuum means for producing a vacuum within the chamber such that the dry matter and the liquid can be drawn into the chamber through the inlet port;

(c) switch means for automatically turning off the vacuum means when the liquid within the chamber rises to a predetermined upper level and for automatically turning on the vacuum means when the liquid within the chamber drops to a predetermined lower level;

(d) valve means for automatically stopping flow of the liquid from the chamber through the liquid outlet port when the vacuum means is on and for permitting flow of the liquid from the chamber through the liquid outlet port when the vacuum means is off; and (e) a tubular separator disposed within the chamber and bounding an internal passageway, the separator having an exterior surface extending from an upper end to an opposing lower end, the lower end having a maximum outer diameter greater than a maximum outer diameter of the upper end, the upper end of the separator being in communication with the vacuum means such that air within the chamber exits the chamber by passing through the passageway from the lower end to the upper end.

2. A vacuum system as recited in claim 1, wherein the vacuum means comprises a motor disposed within the chamber of the first canister.

3. A vacuum system as recited in claim 1, wherein the vacuum means comprises a separate and discrete second canister having a motor disposed therein, the second canister being coupled with the first canister by a conduit.

4. A vacuum system as recited in claim 1, wherein the switch means comprises a float switch disposed within the chamber of the canister.

5. A vacuum system as recited in claim 1, wherein the valve means comprises a check valve coupled with the outlet port, the check valve including:

(a) a housing bounding a passageway, the passageway having a central longitudinal axis; and (b) a flapper rotatably disposed within the housing so as to selectively seal the passageway closed.

6. A vacuum system as recited in claim 5, wherein the check valve is disposed such that the flapper is freely suspended in a substantially vertical orientation when resting so that the passageway is at least partially open and the central longitudinal axis of the passageway is disposed at an angle in a range between about 30° to about 70° relative to a vertical plane.

7. A vacuum system as recited in claim 1, further comprising a filter bag disposed within the chamber in vertical alignment below the separator.

8. A vacuum system as recited in claim 1, further comprising a collecting cone disposed within the chamber, the collecting cone having a radially enlarged upper end configured to receive the dry matter and liquid entering the chamber and an opposing constricted lower end.

9. A vacuum system as recited in claim 8, further comprising a filter bag coupled with the lower end of the collecting cone, the filter bag being configured to allow liquid to pass therethrough.

10. A vacuum system as recited in claim 1, further comprising a filter disposed within the passageway of the separator.

11. A vacuum system for vacuuming both dry matter and liquid, the system comprising:

(a) a substantially cylindrical canister having an inlet port, an air outlet port, and a liquid outlet port, the canister having a chamber configured to hold the liquid, the canister also having an upper portion and a lower portion, the upper and lower portions being selectively separated to enable routine access to the chamber;

(b) a motor coupled with the canister so as to produce a relative vacuum within the chamber when the motor is on;

(c) a switch coupled with the motor, the switch being configured to selectively turn the motor on and off based on the level of the liquid within the chamber;

(d) a valve coupled with the liquid outlet port, the valve controlling the flow of the liquid from the chamber through the outlet port; and (e) a filter bag disposed within the chamber of the canister, the filter bag being positioned in substantially vertical alignment below the air outlet port and the inlet port such that liquid entering the chamber through the inlet port subsequently passes through the filter bag.

12. A vacuum system as recited in claim 11, wherein the motor is disposed within the chamber of the canister.

13. A vacuum system as recited in claim 11, wherein the switch comprises a float switch disposed within the chamber of the canister.

14. A vacuum system as recited in claim 11, wherein the valve comprises a check valve.

15. A vacuum system as recited in claim 11, further comprising a collecting cone disposed within the chamber below the inlet port, the collecting cone having a radially enlarged upper end configured to receive the dry matter and liquid entering the chamber through the inlet port, the collecting cone also having a constricted lower end with an opening formed thereat, the filter bag being coupled with the collecting cone such that material passing through the opening at the lower end of the collecting cone passes through the filter bag.

16. A vacuum system for vacuuming both dry matter and liquid, the system comprising:

(a) a substantially vertically disposed canister having a substantially cylindrical interior side wall bounding a chamber, the chamber being configured to hold a liquid;

(b) a transfer conduit having a first end and an opposing second end, at least a portion of the transfer conduit horizontally extending a distance from the substantially cylindrical interior side wall of the canister to a terminus of the transfer conduit disposed within the chamber of the canister, the terminus defining an inlet port through which the dry matter and liquid enters the chamber;

(c) a fluid line fluid coupled with the transfer conduit;

(d) a control valve coupled with the fluid line, the control valve being operable between an open position wherein fluid flows from the fluid line into the transfer conduit and a closed position wherein fluid is stopped from flowing from the fluid line into the transfer conduit;

(e) vacuum means for producing a vacuum with the chamber such that the dry matter and the liquid can be drawn into the chamber through the transfer conduit;

(f) switch means for automatically turning off the vacuum means and closing the control valve when the liquid within the chamber rises to a predetermined upper level and for automatically turning on the vacuum means and opening the control valve when the liquid within the chamber drops to a predetermined lower level; and (g) a tubular separator disposed within the chamber of the canister adjacent to the transfer conduit.

17. A vacuum system as recited in claim 16, wherein the fluid line couples with the transfer conduit at a distance in a range between about 5 inches to about 11 inches from the terminus at the second end of the transfer conduit.

18. A vacuum system as recited in claim 16, wherein the transfer conduit projects into the chamber of the canister in a range between about 5 inches to about 11 inches from the interior side wall of the canister.

19. A vacuum system as recited in claim 16, wherein the transfer conduit projects into the chamber of the canister at an orientation substantially tangential to the interior surface of the canister bounding the chamber.

20. A vacuum system as recited in claim 16, wherein the switch means comprises a float valve disposed within the chamber of the canister.

21. A vacuum system as recited in claim 16, wherein the canister has a liquid outlet port with a check valve coupled thereto.

22. A vacuum system for vacuuming both dry matter and liquid, the system comprising:

(a) a canister having an air outlet port and a liquid outlet port, the canister having a chamber configured to hold a liquid;

(b) a vacuum port disposed at a distance away from the canister;

(c) a transfer conduit having a first end coupled with the vacuum port and an opposing second end coupled with the canister (d) a fluid port disposed adjacent to the vacuum port;

(e) a first fluid line coupled with the fluid port, the first fluid line being configured to deliver a fluid to the fluid port;

(f) vacuum means for producing a vacuum within the chamber such that the dry matter and the liquid can be drawn into the chamber through the transfer conduit, the vacuum means comprising a motor disposed within the chamber of the canister;

(g) switch means for automatically turning off the vacuum means when the liquid within the chamber rises to a predetermined upper level and for automatically turning on the vacuum means when the liquid within the chamber drops to a predetermined lower level; and (h) valve means for automatically stopping flow of the liquid from the chamber through the liquid outlet port when the vacuum means is on and for permitting flow of the liquid from the chamber through the liquid outlet port when the vacuum means is off.

23. A vacuum system as recited in claim 22, further comprising means for combining a concentrate into the first fluid line.

24. A vacuum system as recited in claim 22, further comprising a second fluid line fluid coupled with the transfer conduit adjacent to the canister.

25. A vacuum system for vacuuming both dry matter and liquid, the system comprising:

(a) a substantially cylindrical canister having an inlet port, an air outlet port, and a liquid outlet port, the canister having a chamber configured to hold the liquid;

(b) a motor disposed within the chamber of the canister, the motor being configured to produce a vacuum within the chamber such that the dry matter and the liquid can be drawn into the chamber through the inlet port;

(c) switch means for automatically turning off the motor when the liquid within the chamber rises to a predetermined upper level and for automatically turning on the motor when the liquid within the chamber drops to a predetermined lower level;

(d) valve means for automatically stopping flow of the liquid from the chamber through the liquid outlet port when the motor is on and for permitting flow of the liquid from the chamber through the liquid outlet port when the motor is off;

(e) a tubular cyclonic separator disposed within the chamber and bounding an internal passageway, the separator having an exterior surface extending from an upper end to an opposing lower end, the lower end having a maximum outer diameter greater than a maximum outer diameter of the upper end, the upper end of the separator being in communication with the motor such that air within the chamber exits the chamber by passing through the passageway from the lower end to the upper end; and (f) a filter bag disposed within the chamber in vertical alignment below the cyclonic separator.

* * * * *

UNITED STATES PATENT AND TRADEMARK OFFICE

CERTIFICATE OF CORRECTION

PATENT NO. : 6,237,186 B1
DATED : May 29, 2001
INVENTOR(S) : Robert S. Griffiths It is certified that error appears in the above-identified patent and that said Letters Patent is hereby corrected as shown below:

Title page,
ABSTRACT, line 4, after "canister" change "though" to -- through --

Column 4,
Line 20, after "directly" change "couple" to -- coupled --

Column 5,
Line 58, after "depicted in" change "Figure" to -- Figure 1, --

Signed and Sealed this

Thirtieth Day of April, 2002

*Attest:*

*Attesting Officer*

JAMES E. ROGAN
*Director of the United States Patent and Trademark Office*